US008771113B2

(12) United States Patent
Patton

(10) Patent No.: US 8,771,113 B2
(45) Date of Patent: Jul. 8, 2014

(54) BROADHEAD FOR IMPROVED ROTATION AND BONE-PIERCING CAPABILITY

(71) Applicant: Stephen C. Patton, Blairsville, GA (US)

(72) Inventor: Stephen C. Patton, Blairsville, GA (US)

(73) Assignee: Medicine Bear Archery, LLC, Blairsville, GA (US)

( * ) Notice: Subject to any disclaimer, the term of this patent is extended or adjusted under 35 U.S.C. 154(b) by 0 days.

(21) Appl. No.: 13/759,720

(22) Filed: Feb. 5, 2013

(65) Prior Publication Data

US 2013/0203530 A1 Aug. 8, 2013

Related U.S. Application Data

(60) Provisional application No. 61/595,348, filed on Feb. 6, 2012.

(51) Int. Cl.
*F42B 6/08* (2006.01)

(52) U.S. Cl.
USPC ..... 473/583

(58) Field of Classification Search
USPC ..... 473/582, 583, 584
See application file for complete search history.

(56) References Cited

U.S. PATENT DOCUMENTS

| | | | | |
|---|---|---|---|---|
| 2,350,581 | A * | 6/1944 | Boose | 473/583 |
| 2,370,270 | A * | 2/1945 | Trittin et al. | 473/583 |
| 2,373,216 | A * | 4/1945 | Zwickey | 473/583 |
| 2,589,137 | A * | 3/1952 | Ramsey | 473/583 |
| 2,676,017 | A * | 4/1954 | Selent et al. | 473/583 |
| 3,653,664 | A * | 4/1972 | Gentellalli | 473/583 |
| 4,210,330 | A | 7/1980 | Kosbab | |
| 4,505,482 | A * | 3/1985 | Martin, Sr. | 473/583 |
| 4,534,568 | A | 8/1985 | Tone | |
| 5,482,294 | A | 1/1996 | Sullivan et al. | |
| 5,879,252 | A | 3/1999 | Johnson | |
| 6,258,000 | B1 | 7/2001 | Liechty, II | |
| 7,182,706 | B2 | 2/2007 | Barrie | |
| 8,147,362 | B2 | 4/2012 | Muntanion et al. | |
| 8,210,971 | B1 | 7/2012 | Fulton | |

* cited by examiner

*Primary Examiner* — John Ricci
(74) *Attorney, Agent, or Firm* — Gardner Groff Greenwald & Villanueva, PC

(57) ABSTRACT

A broadhead for increased target penetrability in use with an arrow shaft. The broadhead includes a receiver that is configured to receive the arrow shaft. The receiver includes a central axis. The broadhead also includes a pair of oppositely-directed blades offset from the receiver central axis. The blades include a tapered geometry.

19 Claims, 3 Drawing Sheets

BROADHEAD FOR IMPROVED ROTATION AND BONE-PIERCING CAPABILITY

CROSS-REFERENCE TO RELATED APPLICATION

This application claims the priority benefit of Provisional Patent Application 61/595,348 filed on Feb. 6, 2012, which is hereby incorporated herein by reference.

TECHNICAL FIELD

The present invention relates generally to archery and, in particular, to broadheads for arrows.

BACKGROUND

Archery is a very popular activity and arrows are commonly used for hunting game animals. In order to improve accuracy and effectiveness, an arrow should remain straight as it flies through the air towards a target. Fletching, for example feathers, can be applied to the arrows to increase stabilization and increase rotation during flight.

Broadheads are a popular tip attached to an arrow shaft when used for hunting game animals. These broadheads can be sharp, so that they can pierce the hide of the target game animals. Traditional broadheads are subject to wind plane and can have erratic and inconsistent flights even if used with fletching. Traditional broadheads also have several blades extending in a variety of axial directions to try to stabilize the flight path. But, these variable-axes blades hinder the penetration of the broadhead into the hide of the target animal.

Accordingly, it can be seen that needs exist for improved broadhead that provides stable flight and penetration. It is to the provision of solutions to these and other problems that the present invention is primarily directed.

SUMMARY

Generally described, the present invention relates to broadhead for use with an arrow shaft. The broadhead has a tip, a tapering body, for example a ferrule, and a pair of offset blades. When the pair of offset blades are contacted with a downward air force, the broadhead is forced into rotational movement.

In a first example embodiment, the invention relates to a broadhead for increased target penetrability in use with an arrow shaft. The broadhead includes a receiver that is configured to receive the arrow shaft. The receiver includes a central axis. The broadhead also includes a pair of oppositely-directed blades offset from the receiver central axis. The blades include a tapered geometry.

In a second example embodiment, the invention relates to a broadhead for increased target penetrability. The broadhead includes a ferrule with a base end and body with a central axis. The ferrule includes a tapered outer surface from the base end to the body. The broadhead also includes a pair of blades offset from the ferrule body central axis. The pair of blades extend the length of the ferrule body.

In a third example embodiment, the invention relates to a broadhead for increased target penetrability. The broadhead includes a body with a tapered outer surface. The body includes a base and a tip. The broadhead also includes a pair of blades extending tangentially from opposite positions on the body outer surface. The pair of blades include a base edge and a tapered outer edge extending from the base edge to the body.

The specific techniques and structures employed to improve over the drawbacks of the prior devices and accomplish the advantages described herein will become apparent from the following detailed description of example embodiments and the appended drawings and claims.

DETAILED DESCRIPTION OF EXAMPLE EMBODIMENTS

Generally described, the present invention relates to a broadhead arrowhead that is used in conjunction with an arrow shaft. This broadhead can be used for recreational archery or for hunting game animals.

Figure 1:
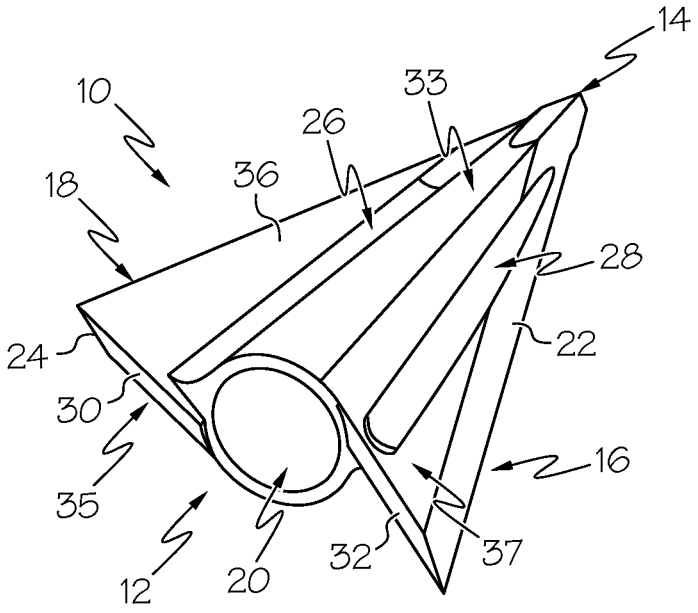
FIG. 1 is an underneath perspective view of a broadhead according to an example embodiment of the present invention.
Figure 2:
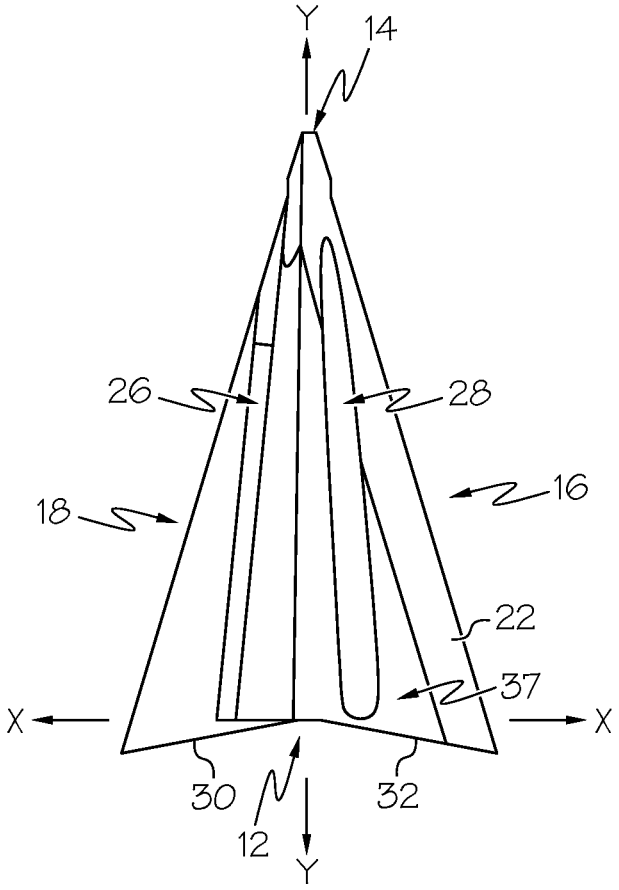
FIG. 2 is a front view of the broadhead of FIG. 1.
Figure 3:
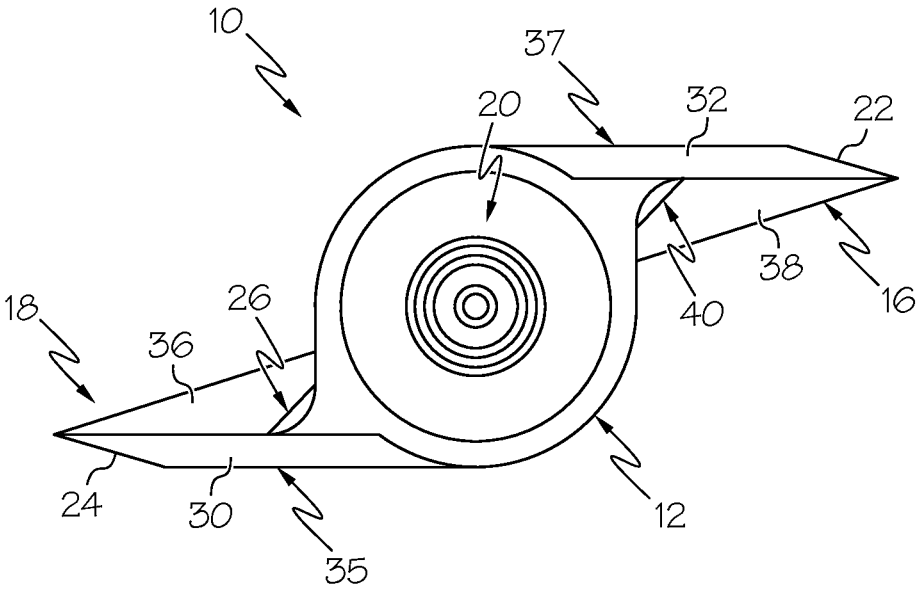
FIG. 3 is a bottom view of the broadhead of FIG. 1.
Figure 4:
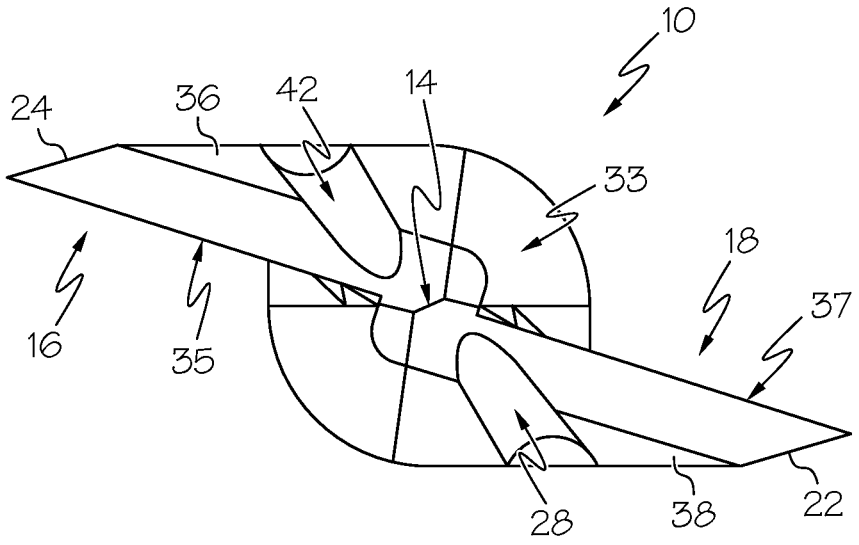
FIG. 4 is a top view of the broadhead of FIG. 1.
Figure 5:
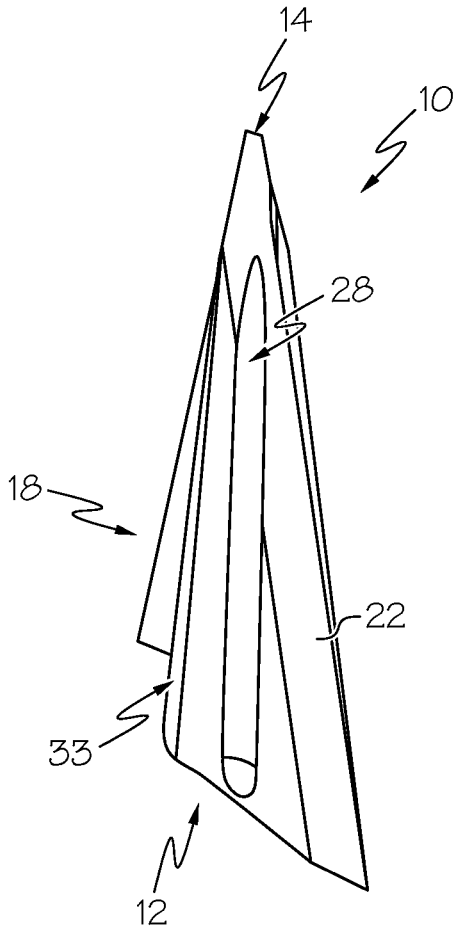
FIG. 5 is a side perspective view of the broadhead of FIG. 1.
Figure 6:
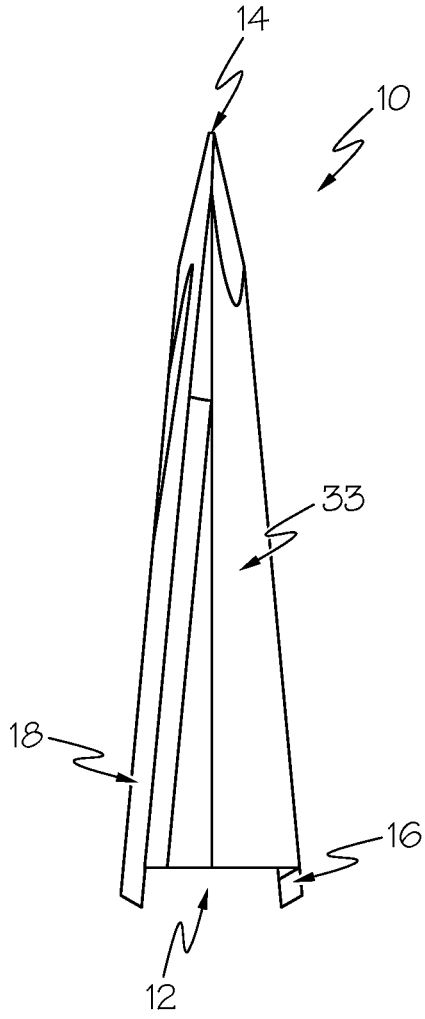
FIG. 6 is a side view of the broadhead of FIG. 1.

FIGS. 1-6 show a broadhead 10 according to an example embodiment of the present invention. The broadhead 10 includes a body 33, for example a ferrule, with a base end 12 and a hollow core 20 and a tip end 14. As depicted, the body 33 exterior can have a generally tapering conical geometry and the hollow core receiver 20 can have a generally conical geometry. As depicted, the base end 12 has an annular shape with a central aperture that provides access to the hollow core 20. In use, an arrow shaft can be inserted through the base end 12 aperture and into the hollow core receiver 20. The arrow shaft can be secured within the hollow core receiver 20 through a friction fit or adhesive.

As depicted, the broadhead 10 includes a pair of blades 16, 18 secured to, and/or extending from, the body 33. Each blade 16, 18 has a tapered shape with a base edge 30, 32 and a tapered outer edge 24, 26 that tapers from the base edge to a location substantially near the broadhead point 14. The blades 16, 18 extend in opposing directions from opposing points on the circumferential outer surface of the body 33. As particularly depicted in FIG. 2, the base edges 30, 32 can extend from the body base end 12 at an oblique angle from the horizontal (X) and vertical (Y) axes of the body 33. For example, the base edges 30, 32 can extend at oblique angles in a direction toward the point 14 or in a direction away from the point (i.e., barbed). Alternatively, the base edges can extend parallel to the horizontal axis and perpendicular to the vertical axis, creating a non-barbed geometry.

Each blade 16, 18 has an inwardly-facing surface 36, 38 and an opposite outwardly-facing surface 35, 37. Preferably, the outwardly-facing surfaces 35, 37 extend in a tangential direction from the outer surface of the body 33. As depicted, the inwardly-facing surfaces 36, 38 extend from the surface of the body 33 as would a secant line from one point on a circle. Preferably, the inwardly-facing surfaces 36, 38 secure to the outer surface of the body 33 with a gradual curved surface 26, 40. As particularly depicted in FIG. 3, at least near the base edge 30, 32 the outwardly-facing surface 35 extends along a parallel axis to the inwardly-facing surface 36 and outwardly-facing surface 37 extends along a parallel axis to the inwardly-facing surface 38. Preferably, the blades 16, 18 have a generally consistent thickness between the outwardly-facing surfaces 35, 37 and the inwardly-facing surfaces 36, 38.

Preferably, the outwardly-facing surface 35 extends along a parallel axis to the inwardly-facing surface 36 and the outwardly-facing surface 37 extends along a parallel axis to the inwardly-facing surface 38, each from the base edge 30, 32 to a location along the body 33 substantially near the broadhead tip 14.

As depicted, the blades 16, 18 each extend from, or follow, the surface geometry of the body 33 from the base edge 30, 32 toward the tip 14. Due to the conical outer surface geometry of the body 33, as particularly depicted in FIGS. 1 and 2, the surfaces of the blades 16, 18 are obliquely-angled with reference to the horizontal axis (X) and vertical axis (Y) of the body. As particularly depicted in FIG. 3, when viewed from the base end 12, the oblique angle of the blades 16, 18 allows the inwardly-facing surfaces 36, 38 to be viewed.

As depicted, the blade tapering outer edges 24, 26 have sloped chisel edges. Alternatively, the tapering outer edges 24, 26 can have V-shaped edges or flat edges. The blades 16, 18 can have longitudinal grooves or channels 28, 42 extending between the base edges 30, 32 and the tip 14, but preferably not contacting the base edges or the tip. As depicted, the longitudinal grooves or channels 28, 42 are positioned substantially close to the location where the blades 16, 18 secure to the ferrule 33. The grooves or channels 28, 42 become gradually shallower from the point near the base edges 30, 32 to the point 14.

The broadhead 10 can have a solid unitary construction. Preferably, the broadhead 10 is constructed of a durable and rigid material, for example steel. Most preferably, the broadhead 10, including the body 33 and blades 16, 18, can be constructed through a single molding process, for example injection molding, that forms a single, solid structure. As particularly depicted in FIGS. 3 and 4, the broadhead 10 has mirror symmetry if the body 33 is horizontally bisected at a midpoint between the blades 16, 18. As a result, FIG. 2 can represent a view of both the front and the back of the broadhead 10. Similarly, FIG. 3 can represent a view of both sides of the broadhead 10.

In use, as an arrow with the broadhead 10 moves through the air, the air applies a downward force onto the outwardly-facing surfaces 35, 37 of the blades. The oblique angle and tapered geometry of the blades 16, 18 provide a surface orientation that interacts with the downward air force to cause the broadhead 10 to rotate. The broadhead 10 can have variable dimensions. As the blades 16, 18 increase in width by the base edge 30, 32 increasing in length from the body 33, the blade surface area increases with which to receive the downward force. This increase in surface area increases the rate of rotation of the broadhead 10 when affected by the downward air force. The longitudinal grooves or channels 28, 42 are designed to both reduce the total mass of the broadhead 12 and also to catch the downward air force that is applied to the blades 16, 18. By catching this downward air force, these grooves or channels 16, 18 assist with stimulating the broadhead 10 to rotate.

The reduced number of blades 16, 18 to two assists the broadhead 10 with piercing a target animal and penetrating bone or tendon, so as to not partially injure the animal.

It is to be understood that this invention is not limited to the specific devices, methods, conditions, or parameters of the example embodiments described and/or shown herein, and that the terminology used herein is for the purpose of describing particular embodiments by way of example only. Thus, the terminology is intended to be broadly construed and is not intended to be unnecessarily limiting of the claimed invention. For example, as used in the specification including the appended claims, the singular forms "a," "an," and "the" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the claimed invention has been shown and described in example forms, it will be apparent to those skilled in the art that many modifications, additions, and deletions can be made therein without departing from the spirit and scope of the invention as defined by the following claims.

What is claimed is:

1. A broadhead for increased target penetrability in use with an arrow shaft, the broadhead having a unitary construction comprising:

a receiver configured to receive the arrow shaft, the receiver comprising a central axis;

a pair of oppositely-directed blades offset from the receiver central axis, the blades comprising a tapered geometry, wherein the pair of oppositely-directed blades do not extend over each other.

2. The broadhead of claim 1, wherein the receiver comprises a hollow conical core.

3. The broadhead of claim 2, wherein the pair of oppositely-directed blades each extend tangentially with respect to the receiver hollow conical core.

4. The broadhead of claim 1, wherein the pair of oppositely-directed blades are obliquely-angled with respect to the receiver central axis.

5. The broadhead of claim 1, wherein the pair of oppositely-directed blades comprise a base edge obliquely-angled with respect to the receiver central axis.

6. The broadhead of claim 1, wherein the receiver comprises an outer surface that tapers with respect to the receiver central axis.

7. The broadhead of claim 6, wherein the receiver outer surface comprises a generally conical geometry.

8. The broadhead of claim 7, wherein the pair of blades extend from the generally-conical receiver outer surface.

9. The broadhead of claim 1, wherein the pair of oppositely-directed blades are configured to cause rotational movement when receiving a downward air force.

10. A broadhead for increased target penetrability, the broadhead comprising:

a ferrule having a unitary construction comprising a base end, a sharp tip and body with a central axis, the ferrule comprising a tapered outer surface from the base end to the sharp tip;

a pair of blades offset from the ferrule body central axis, the pair of blades extending the length of the ferrule body, wherein the pair of blades do not extend over each other.

11. The broadhead of claim 10, wherein the pair of blades extend tangentially from the ferrule outer surface.

12. The broadhead of claim 10, wherein the ferrule comprises a conical outer surface.

13. The broadhead of claim 10, wherein the pair of blades comprise a sloped edge.

14. The broadhead of claim 10, wherein the broadhead is symmetrical.

15. The broadhead of claim 10, wherein the pair of blades comprise a base edge and an outer edge comprising a chisel slope.

16. The broadhead of claim 10, wherein the pair of blades are positioned at an oblique angle with respect to the ferrule body central axis.

17. The broadhead of claim 10, wherein the pair of blades comprises a substantially consistent thickness.

18. The broadhead of claim 10, wherein the pair of blades are configured to cause rotational movement when receiving a downward air force.

19. A broadhead for increased target penetrability, the broadhead comprising:

a body comprising a tapered outer surface, the body having a unitary construction comprising a base and a tip;

a pair of blades extending tangentially from opposite positions on the body outer surface, the pair of blades comprising a base edge and a tapered outer edge extending from the base edge to the body, wherein the pair of oppositely-directed blades do not extend over each other.

* * * * *